US006603066B2

(12) United States Patent
Rogers

(10) Patent No.: US 6,603,066 B2
(45) Date of Patent: Aug. 5, 2003

(54) MODIFIED STRINGED MUSICAL INSTRUMENT

(76) Inventor: Jack Rogers, 825 Dunlap Rd., Hillsboro, OH (US) 45133

( * ) Notice: Subject to any disclaimer, the term of this patent is extended or adjusted under 35 U.S.C. 154(b) by 0 days.

(21) Appl. No.: 10/072,545

(22) Filed: Feb. 8, 2002

(65) Prior Publication Data

US 2002/0069744 A1 Jun. 13, 2002

Related U.S. Application Data

(62) Division of application No. 09/578,808, filed on May 24, 2000, now Pat. No. 6,372,971.

(51) Int. Cl.[7] ..... G10D 3/04
(52) U.S. Cl. ..... 84/298
(58) Field of Search ..... 84/298, 297 R, 84/299, 300, 301, 302, 290

(56) References Cited

U.S. PATENT DOCUMENTS

| | | | |
|---|---|---|---|
| 490,528 | A | 1/1893 | Wooster |
| 2,216,601 | A | 10/1940 | Nelson |
| 2,491,991 | A | 12/1949 | Lundback |
| 3,858,480 | A | 1/1975 | Schneider et al. |
| 5,567,895 | A * | 10/1996 | Aspri et al. ..... 84/294 |

* cited by examiner

*Primary Examiner*—Kimberly Lockett

(57) ABSTRACT

The present invention relates generally to a stringed musical instrument with a modified bridge and acoustic damper. In a preferred embodiment of the invention, the modified stringed instrument is a guitar. The guitar has a face and an interior compartment. The guitar comprises a bridge, two acoustic dampers, and a pivot rod. The bridge is attached to the face of the guitar and comprises a mounting plate and a riser. The riser is attached to the mounting plate by at least one sound post and comprises a width and at least one pair of opposing angled string recesses across the width of the riser. The string recesses are rounded. The bridge has a plurality of string pegs attached to the mounting plate. Each string peg corresponds to a string recess and is attached to the mounting plate at an angle offset from a line extended from its corresponding string recess. The acoustic dampers comprise a first acoustic damping side attached to a second acoustic reflective side. The acoustic dampers are pivotally mounted within the interior compartment of the guitar. The acoustic dampers have a first operative position for damping sound and a second operative position for reflecting sound. The pivot rod is attached to the acoustic dampers such that the pivot rod can manipulate the acoustic dampers to the first and second operative positions. The pivot rod is accessible from an exterior location on the guitar.

3 Claims, 3 Drawing Sheets

MODIFIED STRINGED MUSICAL INSTRUMENT

This application is a divisional application under 37 C.F.R. §1.60 of prior patent application U.S. Ser. No. 09/578,808 filed on May 24, 2000 which is incorporated herein by reference.

BACKGROUND OF THE INVENTION

1. Technical Field

The present invention relates generally to a stringed musical instrument with a modified bridge and acoustic damper.

2. Background Art

Stringed instruments are typically constructed by placing strings in tension over the body of the instrument. The strings are suspended above the body except at certain contact and attachment points by a bridge that is mounted to the body of the instrument. By suspending the strings above the instrument, the bridge allows the strings to vibrate and generate sound for music.

The strings of an instrument compress the bridge and the top of the instrument where they cross over the bridge. The strings also place an opposing force where they are attached to the face of the instrument. The prior art bridge poses several problems. For example, the prior art bridge on acoustic guitars can separate from the top of the acoustic guitar or warp the top of the guitar due to the opposing forces placed on the guitar at the bridge and attachment points. Due to the stresses placed on the body of the instrument by the bridge and the strings of the instrument that it holds, the face of the instrument and the bridge mounting often need to be reinforced to resist long term warping. This reinforced construction tends to damp the sound generated by the strings and reduce the percentage of pure sound emitted.

A number of bridges for stringed instruments have been developed. See U.S. Pat. Nos. 490,528, 2,216,601, 2,491,991, and 3,858,480. However, these bridges do not address the stress-related problems of the prior art bridge. A need exists for a bridge for stringed musical instruments that reduces the stress on the musical instrument, improves the sound of the instrument and increases the operative life span of the instrument.

Stringed musical instruments may also require extensive tuning and adjustments to adjust their sound. A need exists for an acoustic damper that can easily modify the sound of a stringed musical instrument.

SUMMARY OF INVENTION

The present invention relates generally to a stringed musical instrument with a modified bridge and acoustic damper. In a preferred embodiment of the invention, the modified stringed instrument is a guitar. The guitar has a face and an interior compartment. The guitar comprises a bridge, two acoustic dampers, and a pivot rod. The bridge is attached to the face of the guitar and comprises a mounting plate and a riser. The riser is attached to the mounting plate by at least one sound post and comprises a width and at least one pair of opposing angled string recesses across the width of the riser. The string recesses are rounded. The bridge has a plurality of string pegs attached to the mounting plate. Each string peg corresponds to a string recess and is attached to the mounting plate at an angle offset from a line extended from its corresponding string recess. The acoustic dampers comprise a first acoustic damping side attached to a second acoustic reflective side. The acoustic dampers are pivotally mounted within the interior compartment of the guitar. The acoustic dampers have a first operative position for damping sound and a second operative position for reflecting sound. The pivot rod is attached to the acoustic dampers such that the pivot rod can manipulate the acoustic dampers to the first and second operative positions. The pivot rod is accessible from an exterior location on the guitar.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a modified stringed musical instrument.

Figure 1:
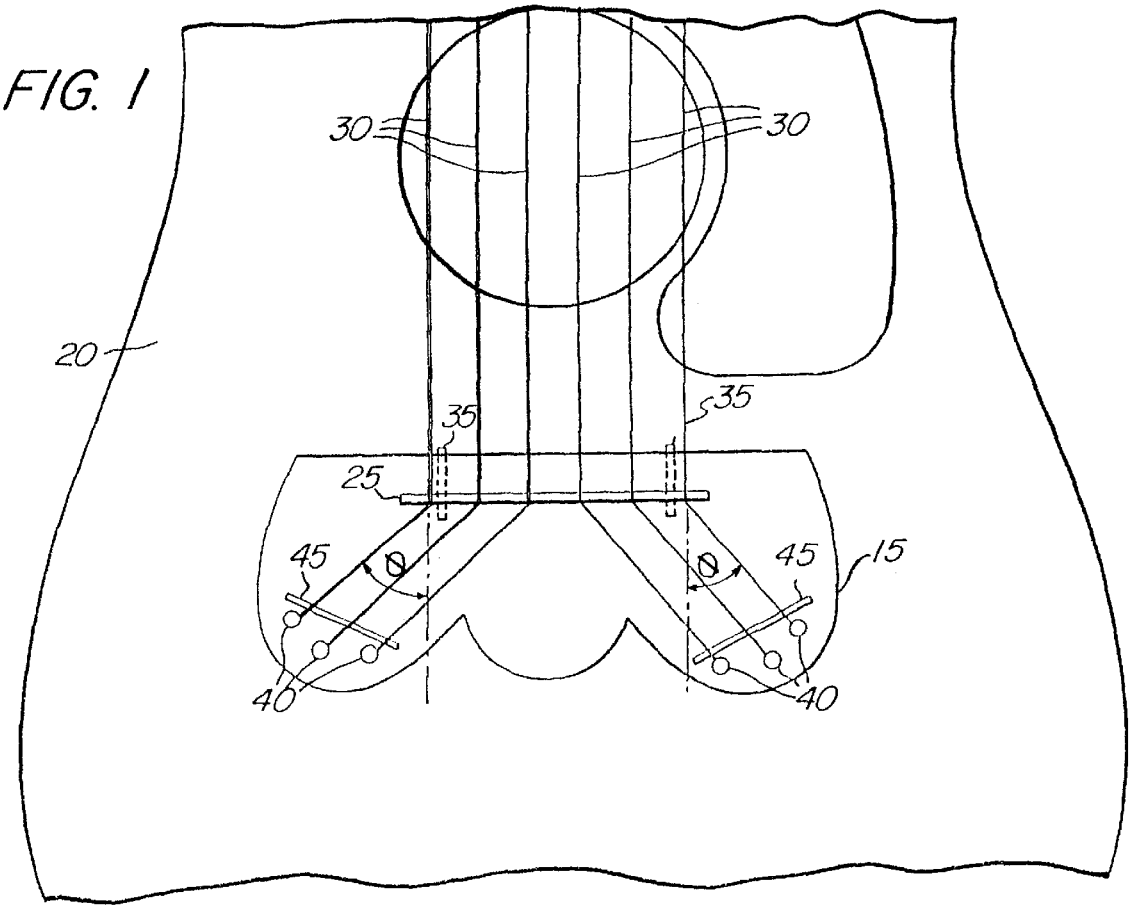
FIG. 1 is a view of a preferred embodiment of the bridge installed on an acoustic guitar.

Referring now to FIG. 1, a bridge 10 is installed on a body of an acoustic guitar 20 and strung with six strings 30. The bridge 10 comprises a mounting plate 15. The mounting plate 15 shown is shaped in a decorative fashion but is of adequate size to mount each element of the bridge 10 on the guitar 20. The mounting plate 15 of the preferred embodiment is wood but can be metal, plastic or wood of sufficient strength to support attachment of the elements of the bridge 10 to the instrument 20 and minimize damping the sound of the instrument 20. In the preferred embodiment of the invention, the mounting plate 15 is attached to the instrument 20 by glue.

The bridge 10 further comprises a riser 25 attached to the mounting plate 15 by four sound posts 35. In the preferred embodiment, the riser 25 and the sound posts 35 are made of brass. However, the riser 25 and sound posts 35 can be made of any material of sufficient strength to attach the riser 25 to the mounting plate 15 and not dampen the sound of the instrument 30. The sound posts 35 transmit sound to the body of the instrument 20.

The preferred embodiment of the bridge 10 further comprises six string pegs 40, one peg for each string 30 of the guitar 20 and split into opposing sets of string pegs 40. Each opposing set of string pegs 40 has a corresponding string peg riser 45.

The strings 30 place a downward force 100 on the bridge at the riser 25.

Figure 2:
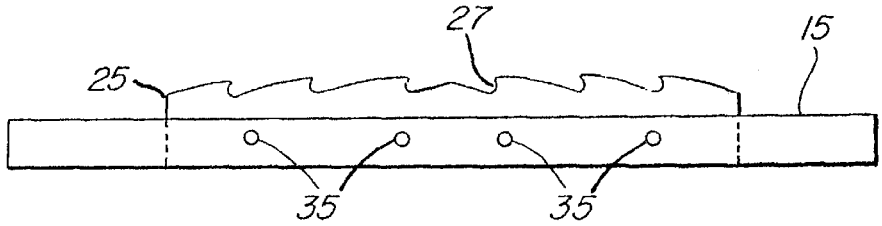
FIG. 2 is an end view of the preferred embodiment riser installed on the mounting plate of the invention.

Referring now to FIG. 2, the riser 25 of the preferred embodiment has six string recesses 27. The string recesses 27 are divided into two sets of three and each set is angled in opposition to the other set. The preferred embodiment of the bridge 10 has rounded string recesses 27 to reduce wear on the strings 30. The string recesses 27 can also be angled holes in the riser 25.

Referring back to FIG. 1, each string peg 40 corresponds to a single string recess 27. Each pair of string pegs 40 are offset an equivalent but opposing angle Ø from an imagined line 55 extending from each string recess 27. The angle Ø can vary between 35 and 75 degrees.

Figure 3:
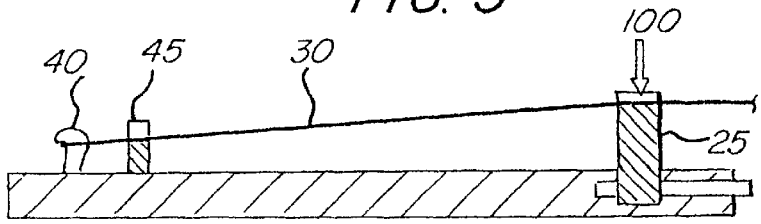
FIG. 3 is a side view of the preferred embodiment of the bridge.

The angled string recesses 27 and the string pegs 40 offset by an opposing angle Ø from an imagined line 55 extending from each string recess 27 re-direct the downward force 100 of the strings 30 on the riser 25. The downward force 100 is directed parallel to the face of the instrument 20. A side view of the preferred embodiment of the bridge and the downward force vector 100 are shown in FIG. 3.

Alternative embodiments of the bridge can be used on any stringed instrument that commonly uses a bridge. The lute, mandolin, cello, violin, viola, and bass are all examples of stringed instruments that can benefit from the invention.

Therefore, the bridge has several advantages over the prior art. The angled string recesses 27 and the string pegs 40 offset by an angle Ø from an imagined line 55 from the string recesses 27 redirect the downward force 100 of the strings 30 parallel to the surface of the instrument 20. This reduces the stress on the surface of the instrument. In turn, it allows the instrument to be made of lighter materials and reduces damping of the instrument's sound.

Figure 4:
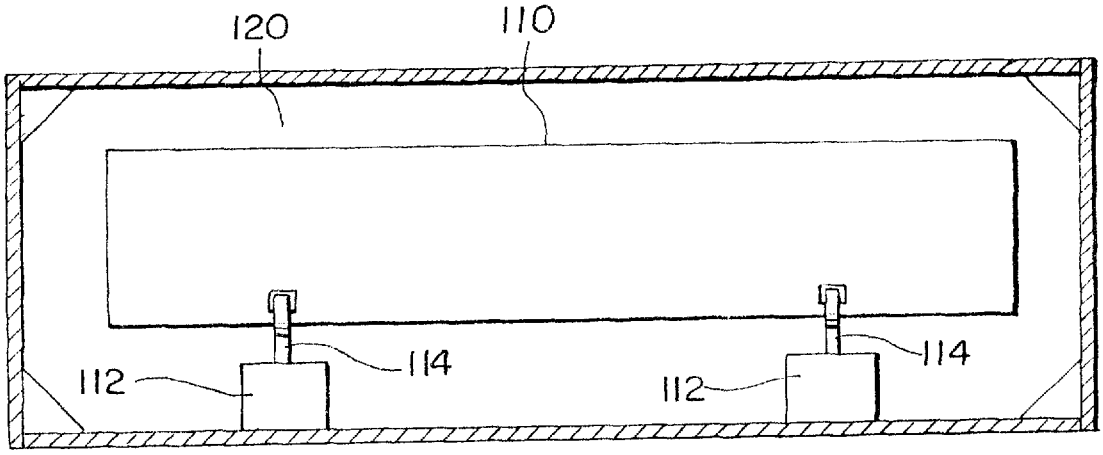
FIG. 4 is a cross-sectional view of an interior compartment of a stringed instrument with an acoustic damper.

Referring now to FIG. 4, an acoustic damper 110 is mounted in an interior compartment 120 of a stringed instrument. The preferred embodiment of the acoustic damper 110 is pivotally mounted on two wood blocks 112 by two eye-hooks 114. Preferrably, the wood blocks 112 are one-half inch (½") tall, three quarters of an inch (¾") wide and three quarters of an inch (¾") deep. The height of the acoustic damper 110 varies depending on the size of the interior compartment 120 of the stringed instrument.

Figure 6:
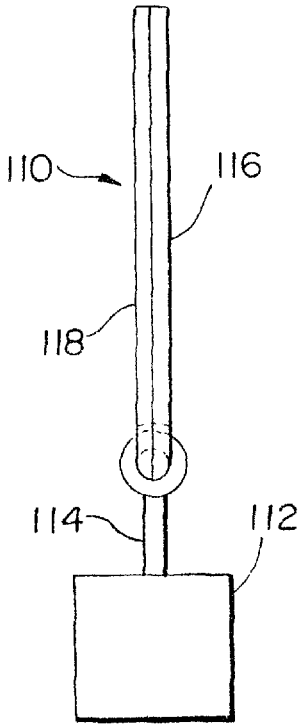
FIG. 6 is a side view of an acoustic damper in the first operative position.
Figure 7:
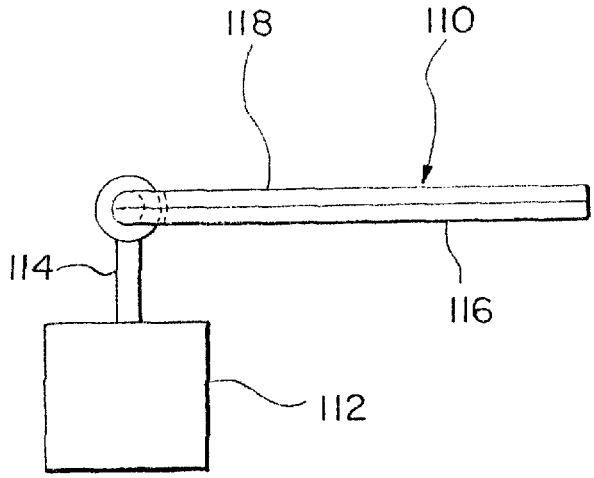
FIG. 7 is a side view of an acoustic damper in the second operative position.

The preferred acoustic damper is one-eighth of an inch (⅛") thick. Referring now to FIGS. 6 and 7, the preferred acoustic damper 110 has a first acoustic damper side 116 attached to a second acoustic reflective side 118. The first acoustic damper side 116 is made of an acoustically absorbent substance. Preferrably, the first acoustic damper side is made of porous foam. Preferably, the second acoustic reflective side 118 is made of a hard acoustically reflective substance such as wood, plastic or metal. The preferred embodiment of the second acoustic reflective side 118 is varnished wood.

The acoustic damper 110 in FIG. 6 is upright in a first operative position. In the first operative position, the first acoustic damper side 116 is exposed to sound in the interior compartment 120 of a stringed instrument. Thus, the first acoustic damper side 116 absorbs sound and thereby alters the sound of the stringed instrument. In FIG. 7, the acoustic damper 110 is lowered to a second operative position. The first acoustic damper side 116 faces downward and is shielded from sound by the second acoustic reflective side 118. The first acoustic damper side 116 is less able to absorb sound in the second operative position and to alter the sound of the stringed instrument. The first operative position and the second operative position of the acoustic damper 110 differ by approximately ninety degrees.

Figure 5:
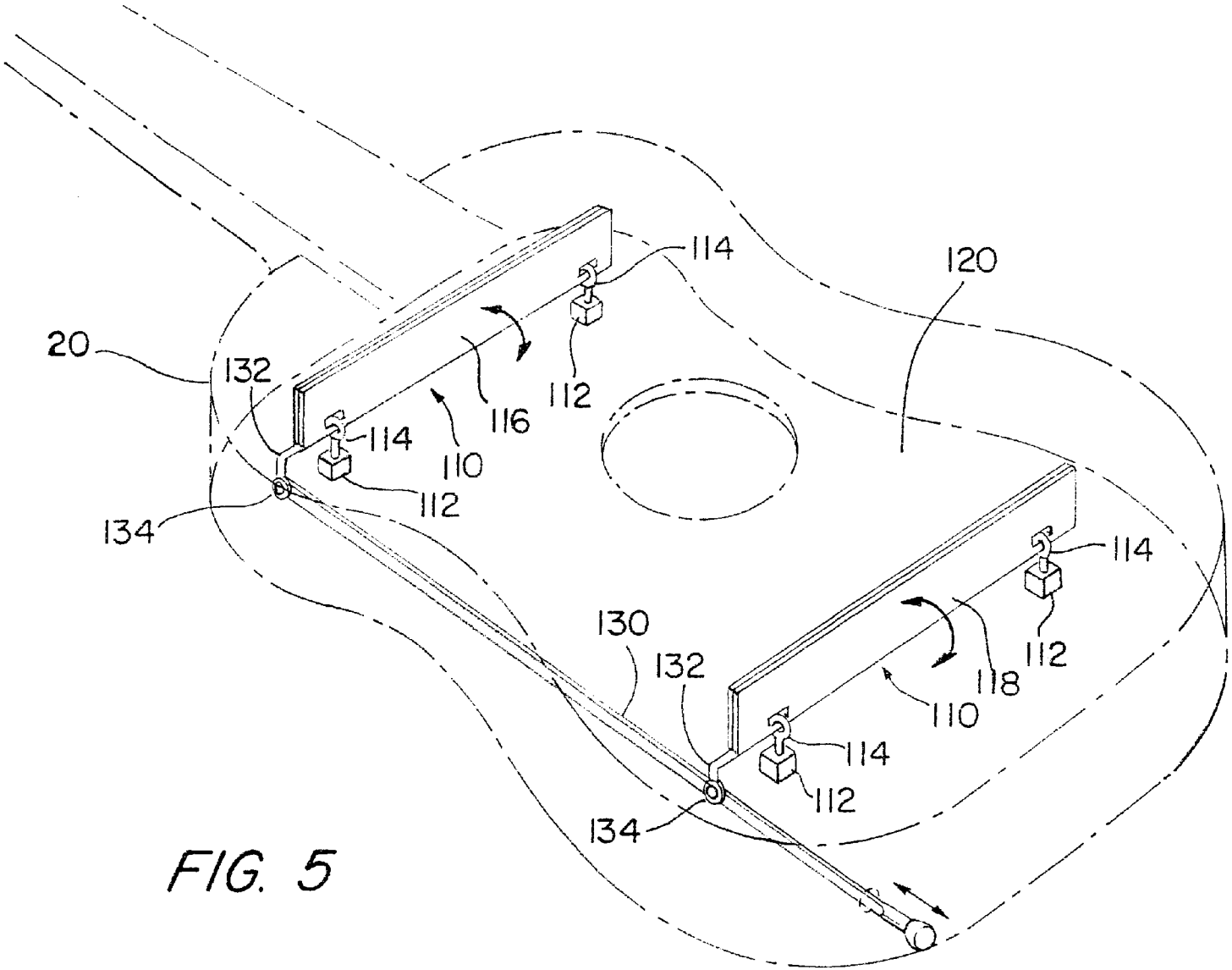
FIG. 5 is an interior view of a guitar with a set of acoustic dampers.

Referring now to FIG. 5, a preferred embodiment of acoustic damper is shown. FIG. 5 shows an acoustic guitar 20 with an interior compartment 120 that has two acoustic dampers 110, each connected to a pivot rod 130 by an elbow 132 and a pin 134. Preferrably, the pivot rod 130 extends outside to an exterior position on the acoustic guitar 20 for improved accessibility. To manipulate the acoustic dampers 110, the pivot rod 130 is moved back and forth in the interior compartment 120. For example, to lower the acoustic dampers 110 to the second operative position, the pivot rod 130 is pushed further into the interior compartment 120 of the guitar 20. To move the acoustic dampers 110 to the first operative position, the pivot rod 130 is pulled further out of the interior compartment 120. The pivot rod 130 can be moved to intermediate positions to vary the sound of the stringed instrument as well.

In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A guitar with a face and an interior compartment, said guitar comprising a bridge, an acoustic damper, and a pivot rod:

said bridge attached to the face of the guitar comprising a mounting plate; a riser, said riser attached to the mounting plate by at least one sound post and comprising a width and at least one pair of opposing angled string recesses across the width of the riser, said string recesses being rounded; a plurality of string pegs attached to said mounting plate, each string peg corresponding to a string recess and attached to said mounting plate at an angle offset from a line extended from its corresponding string recess;

said acoustic damper comprising a first acoustic damping side attached to a second acoustic reflective side and pivotally mounted within the interior compartment; said acoustic damper having a first operative position for damping sound and a second operative position for reflecting sound;

a pivot rod attached to the acoustic damper such that the pivot rod can manipulate the acoustic damper to the first and second operative positions.

2. The guitar of claim 1 further comprising a second acoustic damper.

3. The guitar of claim 1 where the pivot rod is accessible from an exterior location on the guitar.

* * * * *